US007602346B2

(12) United States Patent
Takei et al.

(10) Patent No.: US 7,602,346 B2
(45) Date of Patent: Oct. 13, 2009

(54) ANTENNA MODULE, RADIO DEVICE AND MOBILE RADIO TERMINAL

(75) Inventors: Ken Takei, Hitachi (JP); Takahiro Sugiyama, Hitachi (JP); Yohei Shirakawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 356 days.

(21) Appl. No.: 11/544,279

(22) Filed: Oct. 6, 2006

(65) Prior Publication Data

US 2007/0080870 A1 Apr. 12, 2007

(30) Foreign Application Priority Data

Oct. 6, 2005 (JP) ..... 2005-293903

(51) Int. Cl.
*H01Q 9/00* (2006.01)

(52) U.S. Cl. ..... 343/745

(58) Field of Classification Search ..... 343/745, 343/700 MS, 702; 455/73, 41, 130
See application file for complete search history.

(56) References Cited

U.S. PATENT DOCUMENTS 6,549,766 B2 * 4/2003 Vorenkamp et al. ..... 455/307
7,236,212 B2 * 6/2007 Carr et al. ..... 348/726
2007/0077908 A1 * 4/2007 Vorenkamp et al. ..... 455/323
2007/0105504 A1 * 5/2007 Vorenkamp et al. ..... 455/73

FOREIGN PATENT DOCUMENTS

JP 2000-036702 2/2000
JP 2001-251131 9/2001

* cited by examiner

*Primary Examiner*—Huedung Mancuso
(74) *Attorney, Agent, or Firm*—Scully, Scott, Murphy & Presser, P.C.

(57) ABSTRACT

An antenna module formed with an integrated multilayer substrate having: an antenna with a transmission line; a tuned circuit with a variable capacitance means; a low noise amplifier; and a wave-shaping circuit. The variable capacitance means in the tuned circuit controls a resonance frequency of the antenna by an external control signal being wave-shaped by the wave-shaping circuit, and the antenna outputs a high-frequency output tuned to the controlled resonance frequency to the low noise amplifier directly and then the low noise amplifier outputs the amplified high-frequency output to outside.

26 Claims, 6 Drawing Sheets

| INPUT DATA | CHANNEL | OUTPUT DATA |
|---|---|---|
| 1 | 1 | 55 |
| 2 | 1 | 55 |
| 3 | 2 | 60 |
| ⋮ | ⋮ | ⋮ |
| 254 | 62 | 360 |
| 255 | 63 | 365 |

ANTENNA MODULE, RADIO DEVICE AND MOBILE RADIO TERMINAL

The present application is based on Japanese patent application No. 2005-293903, the entire contents of which are incorporated herein by reference.

BACKGROUND OF THE INVENTION

1. Field of the Invention

This invention relates to an antenna module that receives electric waves of an analogue terrestrial broadcasting and a digital terrestrial television broadcasting and, in particular, to an antenna module that is capable of changing a frequency characteristic according to a received frequency channel so that a reception characteristic can be enhanced. Also, this invention relates to a radio device and a mobile radio terminal comprising the antenna module built-in.

2. Description of the Related Art

Conventionally, antenna modules of various types are known. For example, a mono-pole antenna is shown in JP-A-2001-251131 as conventional antenna receives electric waves of lower frequency used in an analogue terrestrial broadcasting and a digital terrestrial television broadcasting in comparison with electric waves used in a mobile phone.

This sort of antenna module is capable of responding to a wide band required. However, since it comprises a low Q (queue), there is a problem that it comprises a low reception sensitivity. Also, since a wave length of an electric wave received by the antenna is 64 cm, there is a problem that it is difficult for the antenna to be built in a mobile terminal comprising a dimension of about 20 cm at a maximum such as a mobile phone, PDA (Personal Digital Assistants), and a receiving device.

A mobile radio terminal comprising a high performance has been developed. For example, hereinafter it is expected for a mobile phone to advance to a multi-functional phone comprising a receiving function or a radio communication function such as a television broadcasting, a radio broadcasting, a radio LAN (Local Area Network) in addition to a phone function. Each of these radio systems is allocated a different frequency band respectively and uses a channel determined by a frequency division of the frequency band. For example, a digital terrestrial television broadcasting is allocated a wide frequency band being an UHF band of 470 MHz to 770 MHz, each broadcasting station is allocated a narrow band divided the wide frequency band at even intervals of 6 MHz, and it is necessary for viewers to select a frequency of a desired channel for viewing a television broadcasting.

It is preferable to avoid receiving all the wide frequency bands used by each radio system with a single antenna in view of suppressing an interfering wave, and it is expected to achieve a high performance in view of a sensitivity of the antenna by selecting a narrow frequency band for sending and receiving. For these reasons, generally a different antenna is provided for each radio system respectively. And also, a television receiving system may comprise a mechanism that unnecessary frequency channels other than desired frequency channels are removed by a tracking filter circuit and so on disposed at a latter part of the antenna.

On the other hand, since the mobile radio terminal is required to be miniaturized in view of improving portability, each antenna is also required to be miniaturized. In this background, a mobile radio terminal is shown in JP-A-2000-36702, the mobile radio terminal comprising a tuning type antenna controlling an impedance matching central frequency by tuning the frequency in a telephone call frequency.

Further, in this specification "a radio device" means a device conducting a telecommunication function itself of sending and receiving an electric wave and "a mobile radio terminal" means a mobile phone, a PDA, a downsized computer comprising a CPU, a camera, a microphone, a speaker, an indicator and so on.

It is considered that in case that all the frequency bands used by each radio system are inputted to a receiving circuit disposed at a latter part of the antenna, a receiving electric power is consumed too much so that a distortion generates in a latter circuit and a receiving characteristic deteriorates.

Further, it is considered that all the frequency bands are inputted to the receiving circuit so that an undesired wave interferes with a desired wave as an interfering wave and a receiving characteristic deteriorates.

Furthermore, it is considered that in case of the tuning type antenna shown in the JP-A-2001-251131 a signal line for controlling the antenna is outputted from a logical circuit part so that a length of the signal line becomes too long. Therefore, it becomes subject to a noise and so on.

SUMMARY OF THE INVENTION

It is an object of the invention to provide a downsized antenna module which is capable of receiving an electric wave in a required band of an analogue terrestrial broadcasting, a digital terrestrial broadcasting and so on, and is capable of being to be built in a mobile terminal and a receiving device such as a mobile phone, a PDA and so on, by means of controlling a resonance frequency of an antenna comprising a high Q value, a narrow band and a high receiving sensitivity.

It is a further object of the invention to provide a radio device and a mobile radio terminal which is capable of preventing a generation of distortion at a receiving circuit and simultaneously is capable of suppressing an interfering wave.

It is a furthermore object of the invention to provide an antenna module which comprises a structure where an antenna control signal used for controlling a receiving band of this antenna is less subject to a noise and so on, and to provide a downsized antenna which is required for a mobile terminal.

(1) According to one aspect of the invention, an antenna module comprises:

an integrated multilayer substrate comprising: an antenna comprising a transmission line; a tuned circuit comprising a variable capacitance means; a low noise amplifier; and a wave-shaping circuit, wherein the variable capacitance means in the tuned circuit controls a resonance frequency of the antenna by an external control signal being wave-shaped by the wave-shaping circuit, and the antenna outputs a high-frequency output tuned to the controlled resonance frequency to the low noise amplifier directly and then the low noise amplifier outputs the amplified high-frequency output to outside.

In the above invention (1), the following modifications and changes can be made.

(i) The antenna comprises an antenna impedance of being inductive at an output point of the antenna.

(ii) A reference table and a comparing circuit are comprised, and the wave-shaping circuit makes an output converge by a feedback mechanism so that a result of comparing an output signal of the wave-shaping circuit and an external control signal becomes equal to a predetermined value given to the reference table.

(iii) An external control signal terminal, a power supply terminal and a high-frequency signal output terminal are singly comprised as an external terminal, and also a single or a plurality of common ground terminal(s) is (are) comprised.

(iv) The variable capacitance means comprises a switch varying the capacitance of the antenna.

(v) The variable capacitance means comprises a variable capacitance diode varying the capacitance of the antenna.

(vi) A capacitance is comprised between the transmission line and the variable capacitance diode so that a resonance frequency is controlled by means of a direct current backward direction voltage being applied at both ends of the variable capacitance diode and a direct-current electricity is prevented from flowing in a transmission line direction.

(vii) A capacitance value of the variable capacitance diode is controlled by an direct-current voltage applied to an electric supply line in overlapped condition through a resistance, and a capacitance is comprised between a ground and the transmission line being electrically earthed to the ground, and also a capacitance is comprised between an electric supply part and connection points of the electric supply part, the resistance and the transmission line.

(2) According to another aspect of the invention, a radio device comprising the antenna module according to the above invention (1).

In the above invention (2), the following modifications and changes can be made.

(viii) The radio device operates by tuning to a resonance frequency of the antenna module.

(ix) The radio device operates by synchronizing with the antenna module.

(3) According to another aspect of the invention, a mobile radio terminal comprising the radio device according to the above invention (2).

(4) According to another aspect of the invention, a mobile radio terminal comprising the antenna module according to the above invention (1).

(5) According to another aspect of the invention, an antenna module comprises:

an integrated multilayer substrate comprising: an antenna; a low noise amplifier; a tuned circuit; and a wave-shaping circuit, wherein the antenna shares the variable capacitance means with the tuned circuit, an input terminal of the low noise amplifier is connected to an output terminal of the antenna in high-frequency, the wave-shaping circuit is inputted an external control signal, and outputs it to the tuned circuit, and a frequency characteristic of a receiving signal, the frequency characteristic which is received by the antenna and amplified by the low noise amplifier, is controlled by the external control signal.

(6) According to another aspect of the invention, an antenna module comprises:

an integrated multilayer substrate comprising: an antenna; a low noise amplifier; a tuned circuit; and a wave-shaping circuit;

and further comprises an external control signal terminal, a power supply terminal and a high-frequency signal output terminal that are singly comprised as an external terminal, as well as a common ground terminal, wherein the antenna shares the variable capacitance means with the tuned circuit, a control signal supplied from the external control signal terminal is wave-shaped to a signal waveform being capable of controlling the variable capacitance means in the tuned circuit by the wave-shaping circuit, the tuned circuit changes a capacitance value of the variable capacitance means shared with the antenna and moves a central frequency of a radio signal received by the antenna, the low noise amplifier amplifies a received signal of the antenna and supplies it to the high-frequency signal output terminal, and a control of the central frequency of a radio signal received by a receiving circuit of a radio device comprising the antenna module is conducted in conjunction with a control of the central frequency of a radio signal received by the antenna module.

In the above invention (5) or (6), the following modifications and changes can be made.

(x) A frequency band of the radio signal received by the antenna module is narrower than a whole frequency band used by a radio system with the antenna module, and the central frequency of the radio signal received by the antenna module is variable so that the antenna module can receive the whole frequency band used by a radio system with the antenna module.

To achieve the objects of the invention, an antenna constituting an antenna module of the invention comprises a transmission line and a variable capacitance means being connected to a power supply part at one end thereof. The transmission line contributes to absorption of an electromagnetic wave. In case that a length of the transmission line is set to a half wavelength or a quarter wavelength for a wavelength of the electromagnetic wave to be received, the electromagnetic wave is absorbed efficiently. In an antenna according to the object of the invention which can be built-in a downsized portable radio terminal and can absorb an electromagnetic wave utilizing a terrestrial wave such as a wave for a television broadcasting and so on, the electromagnetic wave comprises a wavelength being far shorter than a quarter wavelength, so that the longer the transmission line is set, the more effectively it performs.

The antenna mentioned above comprises a resonance frequency determined by a capacitance element of a variable capacitance means, an inductance element of a transmission line comprising an inductive property, and a capacitance element or an inductance element of the other transmission line. The resonance frequency can be controlled by change the capacitance element of the variable capacitance means.

Since a frequency band used for a current broadcasting system using the terrestrial wave is a VHF band and an UHF band (frequency: 100 to 800 MHz) when the variable capacitance element in the above-mentioned composition is set to 1 pF to be realized easily, a length of the transmission line becomes 3 to 4 cm in a free space so that an adequate length of the transmission line is not ensured. Therefore, a concept of the resonance frequency based on a pure resistance value in a prior art has been corrected so that a new concept of the resonance frequency based on a complex impedance value has been considered. In this case it is no longer necessary that an impedance of the antenna is a pure resistance in an electric supply point. In a case of a broadcasting system using the terrestrial wave which is an object of the invention it is only necessary that a length of the transmission line is set longer and a corrected resonance frequency of the antenna based on a complex impedance comprising an inductive property is considered. In this case an output of the antenna can not be directly connected to a high-frequency circuit comprising a nominal impedance represented by a pure resistance since a transmission loss of electric power occurs due to an impedance mismatching. Therefore, in the invention such a composition is adopted that a low noise amplifier comprising a semiconductor amplifying element is directly connected to at an output terminal of the antenna. In the semiconductor amplifying element in a VHF band and a UHF band, an input impedance can be made capacitative with comparative ease and further both an inductive property of the antenna output and a capacitative property of the semiconductor amplifying element are used, so that an antenna module comprising a transmission line comprising a variable capacitance means and a low noise amplifier comprising a semiconductor amplifying element, suppressing a transmission loss of electric power adequately, and comprising a high efficiency due to a complex conjugated bond can be realized.

In the invention, the antenna is used as a receiving antenna, a receiving frequency band is set narrower than a frequency band used by a radio system, and an external control signal terminal or a composition being capable of inputting an external control signal is comprised so that a receiving central frequency can be controlled by the control signal. Therefore, a receiving circuit of a radio device applying the antenna module such as a mobile phone and so on comprises a function being capable of outputting an antenna control signal.

ADVANTAGES OF THE INVENTION

The invention can provide a downsized and highly sensitive antenna module which is capable of controlling a resonance frequency of an antenna, the antenna module comprising an antenna comprising a transmission line and a variable capacitance means, a low noise amplifier, a wave-shaping circuit, and a tuned circuit. Further, the invention can provide a radio device and a mobile radio terminal which is capable of receiving electric waves of lower frequency used in an analogue terrestrial broadcasting and a digital terrestrial broadcasting in comparison with electric waves used in a mobile phone, by using a receiving circuit being capable of tuning to and synchronizing with the resonance frequency.

The invention can realize a control signal being less subjected to a noise and so on, by outputting a signal for controlling a band characteristic of an antenna from a receiving circuit disposed in a radio device. Further, the invention can improve a receiving sensitivity by setting a sending and receiving frequency band of the antenna to a narrow band, and further the invention can suppress an unnecessary signal so that it can improve a characteristic of distortion generated at receiving the signal. Even if a receiving frequency band of the receiving antenna is set to a narrower band than all the frequency bands used by a radio system, a receiving operation can be accomplished without problems, by changing the central frequency of the receiving antenna corresponding to a control signal from a receiving circuit.

Further, the present invention can provide a downsized antenna by limiting a receiving frequency band so that an antenna module suitably used for a mobile device required to be downsized can be realized In addition, in the invention the antenna module can extract only desired signal so that a filter for suppressing an interfering wave such as an image wave does not have to be disposed in a tuner module which is disposed in a radio device separately. Therefore, the present invention can provide a downsized tuner module so that a downsized mobile device can be realized.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

The invention provides an antenna module which can stabilize a receiving characteristic of a radio device and also downsize the radio device, by limiting a frequency band to a narrow band and by controlling a central frequency received from a receiving circuit so as to be changed.

First Preferred Embodiment

Figure 1:
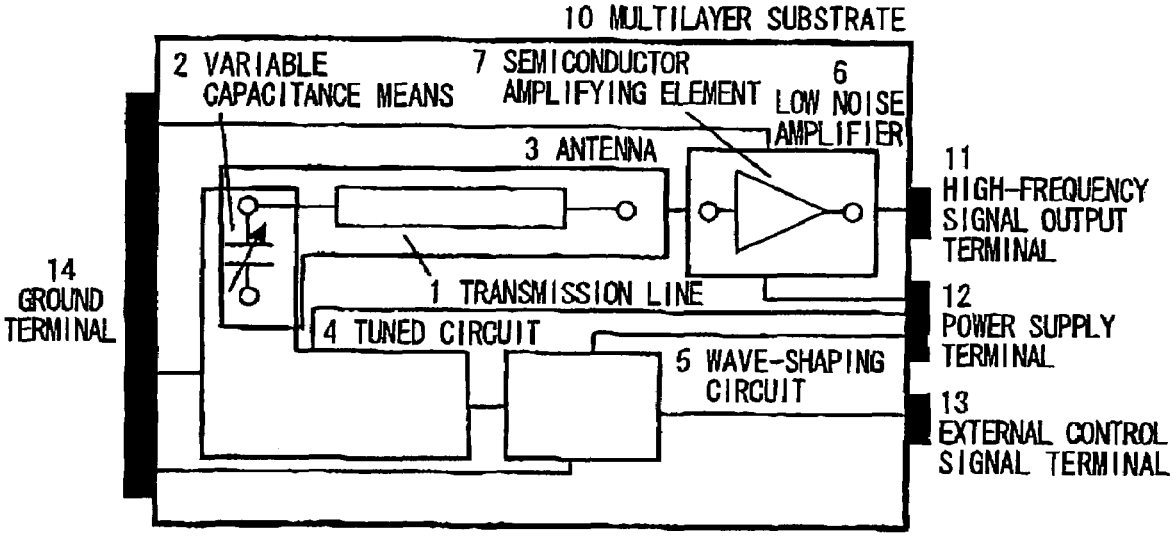
FIG. 1 is a block diagram of an antenna module in a first preferred embodiment according to the invention.

As shown in FIG. 1, an antenna module in a first preferred embodiment according to the invention comprises an integrated multilayer substrate 10 comprising antenna 3 comprising a plurality of transmission lines 1 and a variable capacitance means 2, a tuned circuit 4 comprising the variable capacitance means 2, a wave-shaping circuit 5, and a low noise amplifier 6 comprising a semiconductor amplifying element 7, and further comprising a high-frequency signal output terminal 11, a power supply terminal 12, an external control signal terminal 13, and a ground terminal 14 as an external terminal.

In the embodiment an output of 5 the antenna 3 is directly connected to an input of the low noise amplifier 6 in high-frequency so that a reactance element is reduced to zero approximately, and then an output of the low noise amplifier 6 is sent out to outside of the antenna module from a high-frequency signal output terminal 11. A variable capacitance means 2 comprised in the antenna 3 is also a component of a tuned circuit 4. Therefore, a capacitance value of the variable capacitance means 2 can be variable while synchronizing with and corresponding to an external control signal, when the external control signal supplied from an external control signal terminal 13 is inputted to a wave-shaping circuit 5 and an output of the wave-shaping circuit 5 is inputted to the tuned circuit 4. The change of the capacitance value of the variable capacitance means 2 causes a change of a central frequency of a receiving frequency signal so that the antenna 3 can receive a radio signal to be received with high sensitivity.

Hereinafter, advantages of the invention are explained more in detail. In a conventional antenna the output terminal thereof is directly connected to a frequency circuit substrate so that it is necessary for an impedance at the terminal to be 50 Ω. On the other hand, in a case that the antenna comprises an inductive conductor such as a variable capacity means and a transmission line and so on comprising a 100 to 800 MHz frequency, a lower limit of the capacitance value of the variable capacitance means is approximately 1 pF as a minimum value to be realized by the present technique. To reduce a reactance element at an output terminal of the antenna to zero, it can be realized, for example, by such a condition that a frequency is 600 MHz, a length of the transmission line is 3 cm, and a capacitative value of the variable capacity means is 1 pF. Since the transmission line most highly contributes to an absorption mechanism of an electric wave of an antenna, the longer the transmission line is set, the more the electric wave is absorbed, so that the antenna gain can be enhanced. However, when the transmission line is set longer, an inductance thereof increases so that the reactance element of the output terminal of the antenna also increases from zero to a positive value. For example in such a condition that a frequency is 600 MHz, a length of the transmission line is 6 cm, and a capacitative value of the variable capacity means is 1 pF, an impedance at the output terminal of the antenna becomes 40+j 80Ω. However, the antenna described above can not be disposed on a circuit substrate, even if the antenna gain can be enhanced.

To the contrary, the invention is completed by focusing attention on that an input impedance can be made capacitative with comparative ease in a low noise amplifier comprising a semiconductor amplifying element and in a frequency of 300 to 800 MHz, and a reactance of an output impedance can be reduced to zero with comparative ease, and an antenna comprising an output impedance being inductive and a low noise amplifier comprising an input impedance being capacitative are directly connected in high-frequency, so that at the connection point a condition of a complex conjugation is satisfied and a transmission of electric power from the antenna to the low noise amplifier can be achieved with high efficiency.

Further, a high-frequency signal received at the antenna 3 is amplified by the low noise amplifier 6, almost free from routing through a transmission line such as a microstrip circuit comprising a copper loss, so that deterioration of a receiving sensitivity due to deterioration of a noise factor which is caused by a noise being generated by the copper loss can be reduced drastically and a receiving sensitivity of a whole radio device adopting the antenna module of the invention can be enhanced.

Second Preferred Embodiment

Figure 2:
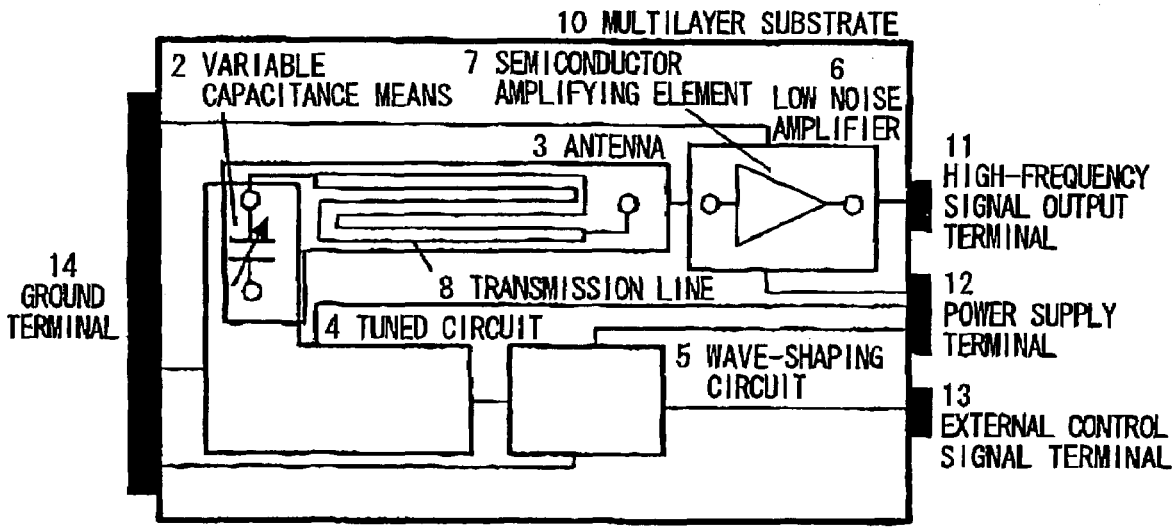
FIG. 2 is a block diagram of an antenna module in a second preferred embodiment according to the invention.

As shown in FIG. 2, an antenna module in a second preferred embodiment is different from the antenna module in the first preferred embodiment in the following points. The antenna module in the second preferred embodiment comprises a transmission line 8 instead of the transmission line 1 in the first preferred embodiment, the transmission line 8 comprising a physical length being longer than the transmission line 1, and comprises a complex conjugated bond between the antenna 3 and the low noise amplifier 6, the complex conjugated bond comprising inductive at a side of the antenna and capacitative at a side of the low noise amplifier. A length of the transmission line can be set longer than the first preferred embodiment, so that an electric wave comprising a frequency band to be absorbed by the antenna module of the invention in a free space can be absorbed more than the first preferred embodiment. On the other hand, the length of the transmission line is long so that an output impedance of the antenna comprises an inductive reactance element. In the embodiment a low noise amplifier 6 comprises a semiconductor amplifying element 7 so that an input impedance of the low noise amplifier 6 can be made capacitative with comparative ease. Therefore, in the embodiment the direct connection in high-frequency between the antenna 3 and the low noise amplifier 6 can be composed by the complex conjugated bond, so that as same as the connection condition of reactance-zero in the first embodiment, electric power absorbed much more by the antenna without a transmission loss of electric power due to an impedance mismatching at the connection part can be led to a high-frequency signal output terminal efficiently, and further both an antenna gain and a receiving sensitivity of a whole radio device adopting the antenna module of the invention can be enhanced.

Third Preferred Embodiment

Figure 3:
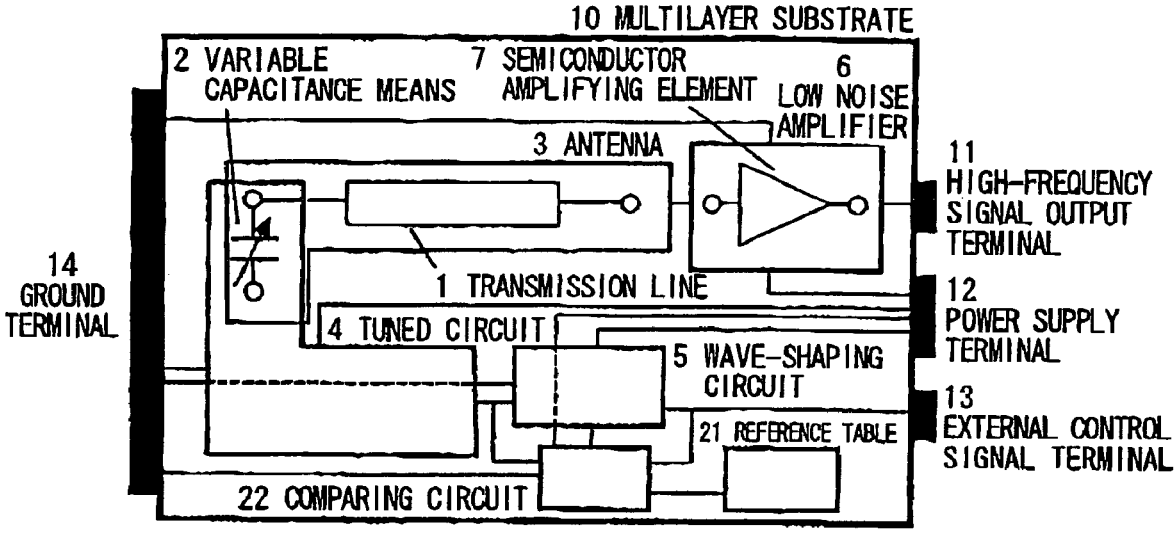
FIG. 3 is a block diagram of an antenna module in a third preferred embodiment according to the invention.

As shown in FIG. 3, an antenna module in a third preferred embodiment is different from the antenna module in the first preferred embodiment in the following points. The antenna module in the third preferred embodiment comprises anew a reference table 21 and a comparing circuit 22. And then the antenna module is operated along the following process. A part of a signal inputted from an external control signal terminal 13 to a wave-shaping circuit 5 and a part of an output of the wave-shaping circuit 5 is defined as a first input and a second input respectively. And the comparing circuit 22 compares the first input with the second input while referring a threshold value preliminarily stored on the reference table 21. Further the output of the wave-shaping circuit 5 is changed by a feedback mechanism until the comparison value falls within an allowable range of the threshold value.

Figure 4:
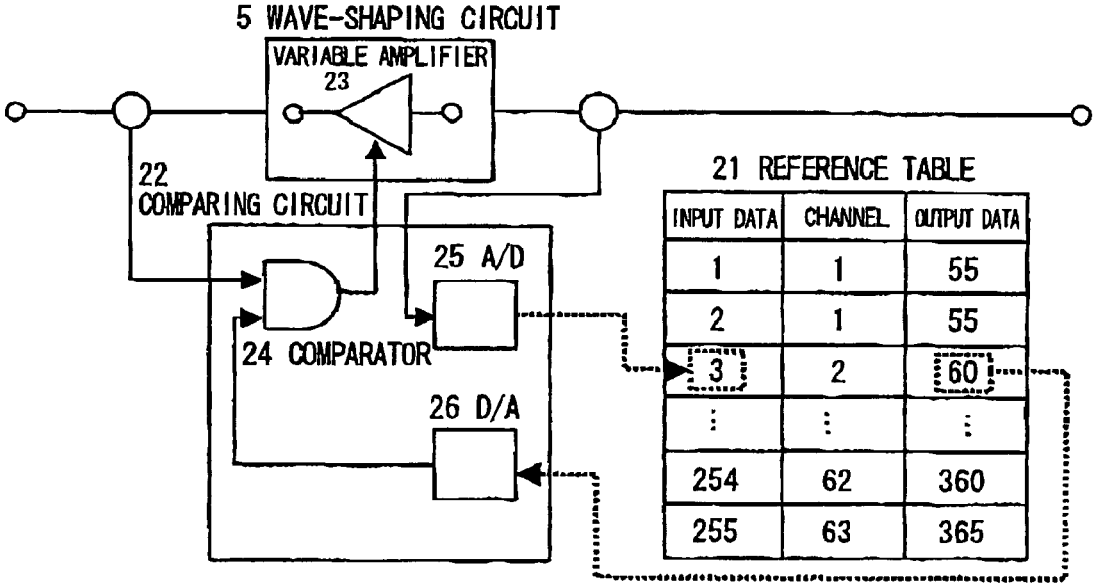
FIG. 4 is an explanatory block diagram showing an operation of a comparing circuit.

FIG. 4 is an explanatory block diagram showing an operation of the comparing circuit 22 while relating the comparing circuit 22, the reference table 21 and the wave-shaping circuit 5. The wave-shaping circuit 5 comprises a variable amplifier 23. And then the comparing circuit 22 is operated along the following process. A part of a signal inputted to the wave-shaping circuit 5 is inputted to the comparing circuit 22 through a branched line and is converted to a digital signal in an analogue/digital converter (A/D) 25 comprised in the comparing circuit 22, and then is inputted to the reference table 21 preliminarily storing relations between a digital input and a digital output corresponding to a frequency channel for broadcasting. Further the reference table 21 sends out an output corresponding to the input to the comparing circuit 22, the output is inputted to a digital/analogue converter (D/A) 26 comprised in the comparing circuit 22 so as to be converted to an analogue signal again, and then the analogue signal is inputted to a converter 24 comprised in the comparing circuit 22 as one of input signals thereof. Another input signal inputted to the converter 24 is a signal branched from the output of the wave-shaping circuit 5. The converter 24 sends these different signals to the variable amplifier 23 of the wave-shaping circuit 5, and then the variable amplifier 23 outputs the different signals while adjusting the signals so as to be reduced to zero.

According to the embodiment, even if an external signal to be inputted to an external control signal terminal 13 is disturbed by some sort of external causes, the antenna 3 can maintain a frequency of an electric wave to be received in a radio device constant, so that a stability in a receiving sensitivity of the antenna module of the invention can be enhanced, and as a result a stability in a receiving sensitivity of the radio device comprising the antenna module of the invention can be also enhanced. Further, it is self-evident that a same composition as the third embodiment can be applied to the embodiment shown in FIG. 2 and by the application the embodiment shown in FIG. 2 additionally comprises same advantages as the third embodiment.

Fourth Preferred Embodiment

Figure 5:
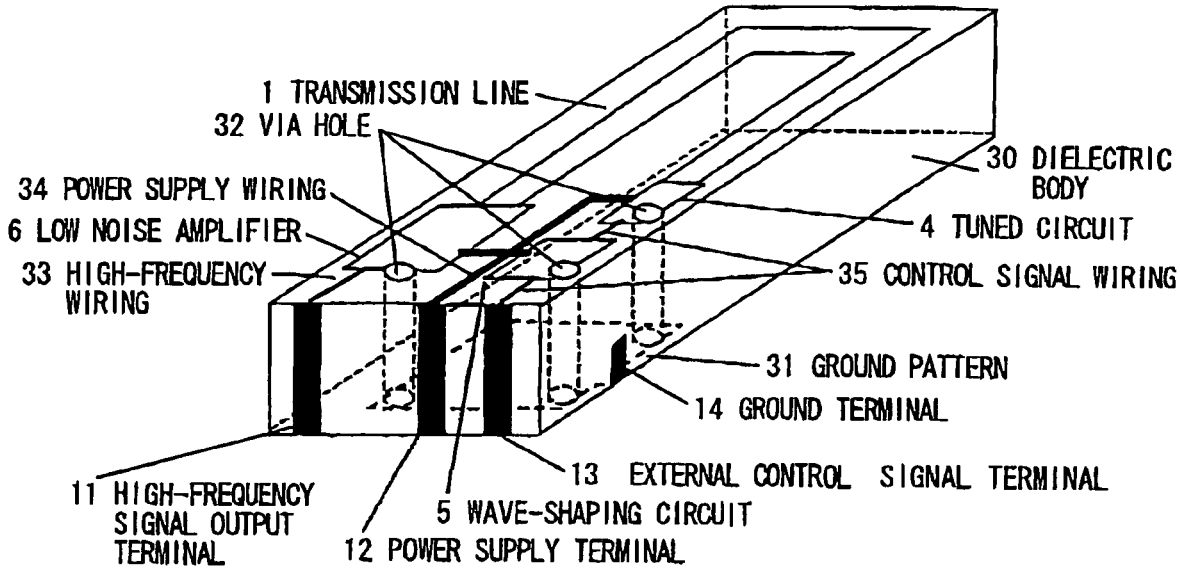
FIG. 5 is a perspective view schematically showing a composition of an antenna module in a fourth preferred embodiment according to the invention.

As shown in FIG. 5, an antenna module in a fourth preferred embodiment comprises components of the first embodiment that is the transmission line 1, the low noise amplifier 6, the tuned circuit 4, and the wave-shaping circuit 5 disposed on an upper surface of a dielectric body 30 of a rectangular parallelepiped shape, a high-frequency signal output terminal 11, a power supply terminal 12, an external control signal terminal 13, and a ground terminal 14 disposed on side surfaces of the dielectric body 30, a ground pattern 31 disposed on a lower surface of the dielectric body 30, via holes 32 disposed inside of the dielectric body 30 and on the upper and lower surfaces of the dielectric body 30, the via holes 32 connecting in high-frequency earth potentials of the low noise amplifier 6, the wave-shaping circuit 5, and the tuned circuit 4 with the ground pattern 31, a high-frequency wiring 33 disposed on an upper surface of the dielectric body 30 connecting in high-frequency an output of the low noise amplifier 6 which is directly connected to the transmission line 1, with the external control signal terminal 13, a control signal wiring 35 disposed on an upper surface of the dielectric body 30 connecting the tuned circuit 4 and the wave-shaping circuit 5 with the external control signal terminal 13, and a power supply wiring 34 disposed on an upper surface of the dielectric body 30 connecting electric power potentials of the low noise amplifier 6, the tuned circuit 4, and the wave-shaping circuit 5. According to the fourth embodiment, the antenna module shown in FIG. 1 can be realized at low cost by a usual integrated multilayer substrate process.

Further, it is self-evident that a same composition as the fourth embodiment can be applied to the second embodiment shown in FIG. 2 and the antenna module shown in FIG. 2 can be realized at low cost by the usual integrated multilayer substrate process.

Fifth Preferred Embodiment

Figure 6:
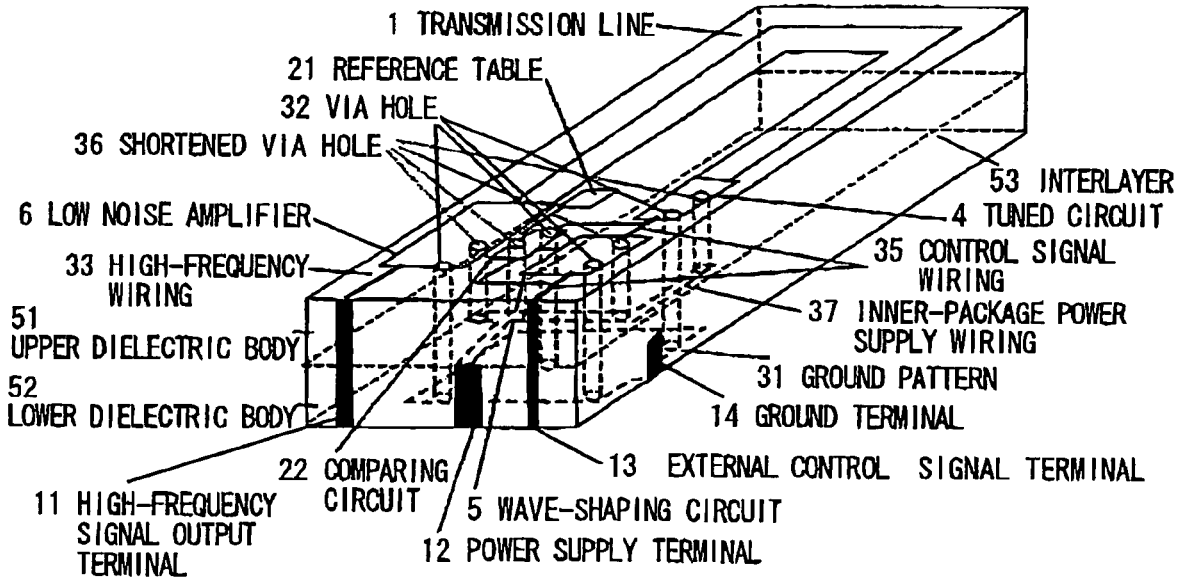
FIG. 6 is a perspective view schematically showing a composition of an antenna module in a fifth preferred embodiment according to the invention.

As shown in FIG. 6, an antenna module in a fifth preferred embodiment comprises components of the third embodiment that is the transmission line 1, the low noise amplifier 6, the tuned circuit 4, and the wave-shaping circuit 5, the comparing circuit 22, and the reference table 21 disposed on an upper surface of an upper dielectric body 51 of a rectangular parallelepiped shape, a high-frequency signal output terminal 11, a power supply terminal 12, an external control signal terminal 13, and a ground terminal 14 disposed on side surfaces of an integral structure composed of the upper dielectric body 51 and a lower dielectric body 52 sharing an interlayer 53, a ground pattern 31 disposed on a lower surface of the lower dielectric body 52, via holes 32 disposed inside of the dielectric bodies 51, 52 and on the upper and lower surfaces of the dielectric bodies 50, 51, the via holes 32 connecting in high-frequency earth potentials of the low noise amplifier 6, the wave-shaping circuit 5, the tuned circuit 4, and the comparing circuit 22 with the ground pattern 31, a high-frequency wiring 33 disposed on an upper surface of the upper dielectric body 51 connecting in high-frequency an output of the low noise amplifier 6 which is directly connected to the transmission line 1, with the high-frequency signal output terminal 11, a control signal wiring 35 disposed on an upper surface of the upper dielectric body 51 connecting the tuned circuit 4, the wave-shaping circuit 5, the comparing circuit 22, and the reference table 21 with the external control signal terminal 13, and a shortened via hole 36 connecting electric power potentials of the low noise amplifier 6, the tuned circuit 4, the wave-shaping circuit 5, and the comparing circuit 22 with an inner-package power supply wiring 37 comprised in the interlayer 53 and also connecting the amplifier 6 and the circuits 4, 5, 22 with the power supply terminal 12 on the upper surface of the lower dielectric body 52. According to the fifth embodiment, the antenna module shown in FIG. 3 can be realized at low cost by a usual integrated multilayer substrate process.

Sixth Preferred Embodiment

Hereinafter, a mobile terminal comprising the antenna module of the invention and a tuner module as one example of a receiving system for a digital terrestrial television broadcasting is explained.

Figure 7:
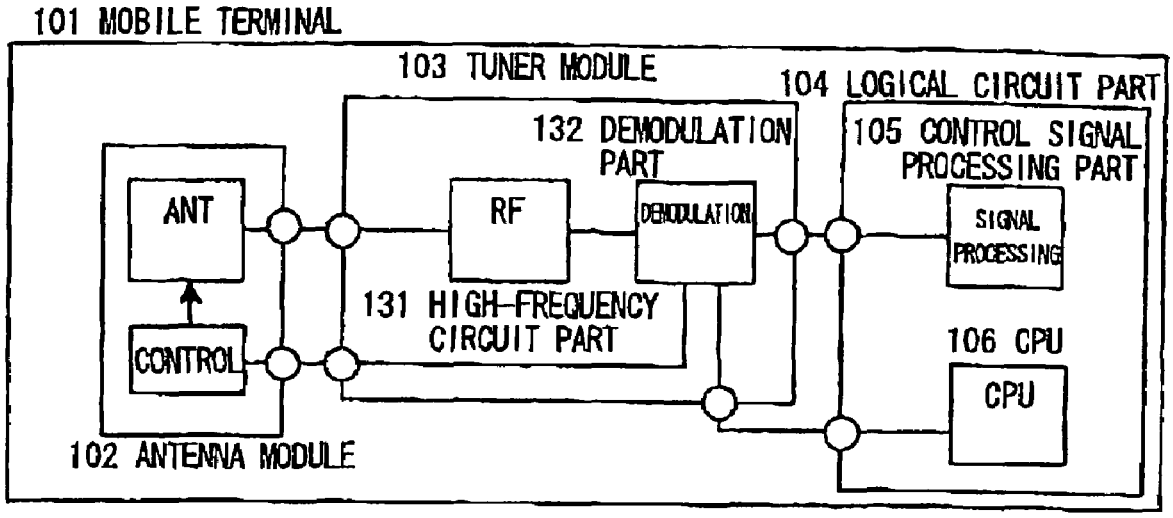
FIG. 7 is a block diagram of a mobile terminal comprising an antenna module according to the invention.

As shown in FIG. 7, a mobile terminal 101 in a sixth preferred embodiment comprises an antenna module 102, a tuner module 103, a high-frequency circuit part 131, a demodulation part 132, a logical circuit part 104, a control signal processing part 105, and a CPU 106 (Central Processing Unit).

A broadcast signal sent from a broadcasting station is received at the antenna module 102 and is inputted to the tuner module 103. The tuner module 103 comprises the high-frequency circuit part 131 and the demodulation part 132 and the broadcast signal inputted to the tuner module 103 is inputted to the high-frequency circuit part 131. In the high-frequency circuit part 131 a frequency channel that users desire to view is selected from the broadcast signal and also an intermediate frequency signal controlled to a most suitable amplitude for an operation of the demodulation part 132 is generated The demodulation part 132 receives the intermediate frequency signal, and conducts treatments such as a digital demodulation treatment and an error correction treatment in this order, and then outputs a digital data signal called as a transport-stream signal. The transport-stream signal comprises a picture signal and a sound signal compressed and multiplexed, is released the multiplex at a logical circuit part 104, receives a digital extension treatment, receives signal treatments such as a picture treatment and a sound treatment, and is outputted from a monitor and a speaker etc. not shown.

Figure 8:
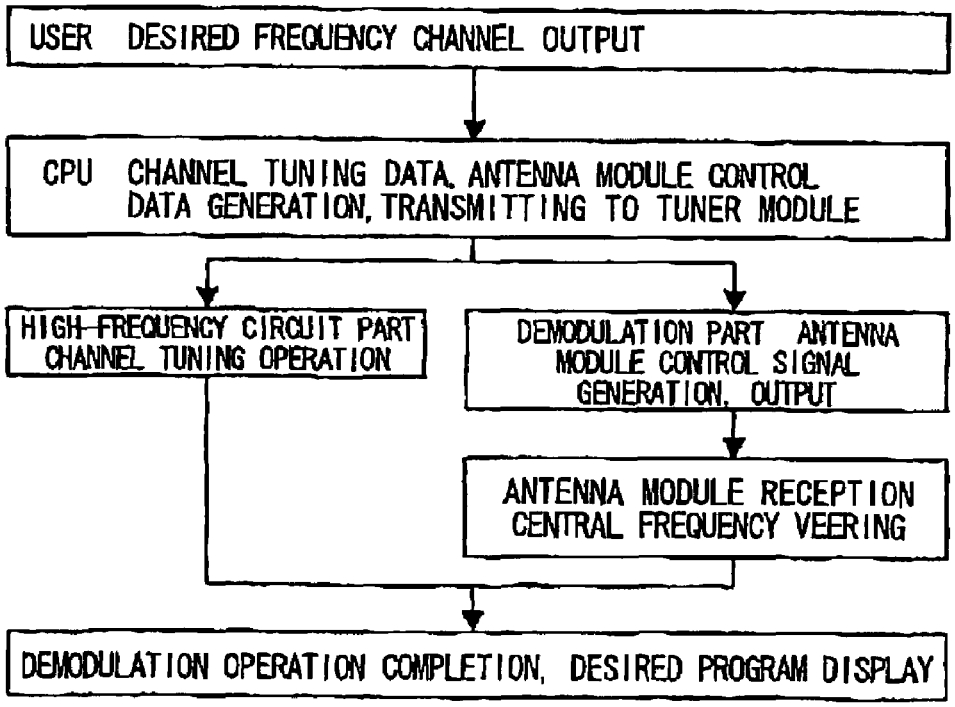
FIG. 8 is a flow chart showing a control of changing a view channel in a mobile terminal.

An operation of the high-frequency circuit part 131 and the demodulation part 132 in the tuner module 103 is controlled by a control signal supplied from a CPU 106 to the tuner module 103. Hereinafter, one example of control flows in a case that users intend to change a view channel is explained by using FIG. 8.

A mobile terminal obtains information of a user desire frequency channel by an operation of users such as depression of a number button. Based on the information, the CPU 106 generates an appropriate control signal corresponding to the user desire frequency channel and sends the control signal to the tuner module 103. The control signal comprises selection information by which a selection operation of the high-frequency circuit part 131 in the tuner module 103 is controlled and the user desire frequency channel is converted to the intermediate frequency signal so as to be outputted to the demodulation part 132. On the other hand, the control signal outputted from the CPU 106 comprises a antenna module control information, and the demodulation part 132 receives the antenna module control information and outputs an antenna module control signal for controlling the antenna to the antenna module. The antenna module receives the antenna module control signal and adjusts an receiving central frequency to the user desire frequency channel.

In the control signal sent from the CPU 106 to the tuner module 103, the selection information and the antenna module control information may be sent as independent and individual data, but it is preferable that the generation of the antenna module control signal in the demodulation part 132 is conducted by utilizing a whole or a part of the selection information. By the composition described above, data volume of the control signal can be reduced since the antenna module control information does not need to be sent individually.

Control of the antenna module needs continuously variable electric volume, but it is not necessary that antenna module control signal is the continuously variable electric volume and it may be outputted as a PWM signal. In this case, in an antenna module control circuit disposed outside of the tuner module 103 it is necessary that the PWM signal is converted to the continuously variable electric volume by using a low-pass filter circuit so as to be supplied to the antenna module. As an other method it can be considered that a digital signal comprising a plurality of bits is supplied to the antenna module. In this case it is necessary that the antenna module control circuit comprises a DA (Digital to Analog) converter circuit and the control signal supplied as the digital signal is converted to the continuously variable electric volume being an analogue signal.

Since it is necessary that the selection of the antenna module receiving frequency by the antenna module control signal is conducted in conjunction with the selection operation of the high-frequency circuit part 131, generation of the antenna module control signal is conducted by the control signal by which the CPU 106 controls the tuner module 103. In a case that the high-frequency circuit part 131 comprises a function of outputting the antenna module control signal, the high-frequency circuit part 131 may output the antenna module control signal under a control of the CPU 106. It is considered that the antenna module control signal outputted from the high-frequency circuit part 131 is directly outputted from the CPU 106, but it is preferable that the tuner module 103 is controlled by the CPU 106 and directly outputs the antenna module control signal, since the generation of the antenna module control signal is conducted at a region nearer to the antenna module and a transmission distance of the antenna module control signal can be shortened. As the result, deterioration in a quality of the antenna module control signal caused by a noise etc. leaking in the antenna module control signal, and an erroneous operation of the antenna module control can be prevented.

In the sixth embodiment, as to a receiving frequency control of the antenna module and a digital control, an example in a case that the antenna module control circuit is disposed outside of the tuner module 103 is shown, but the antenna module control circuit may be disposed in the tuner module 103 or in the antenna module. In a case that the antenna module control circuit is disposed in the antenna module it is only necessary that components shown in the first to fifth embodiment such as the wave-shaping circuit 5, the reference table 21, and the comparing circuit 22 are modified in accordance with the digital control algorithm. In this case the control circuit is not disposed in a region near to the antenna module so that even if the antenna module is disposed far from the tuner module 103, a designer of the mobile terminal can determine a disposition of the tuner module 103 and the antenna module on the mobile terminal circuit substrate with a large degree of freedom. Therefore, as a whole a high-density disposition of circuit components can be achieved and a downsized mobile terminal can be provided.

Seventh Preferred Embodiment

Figure 9:
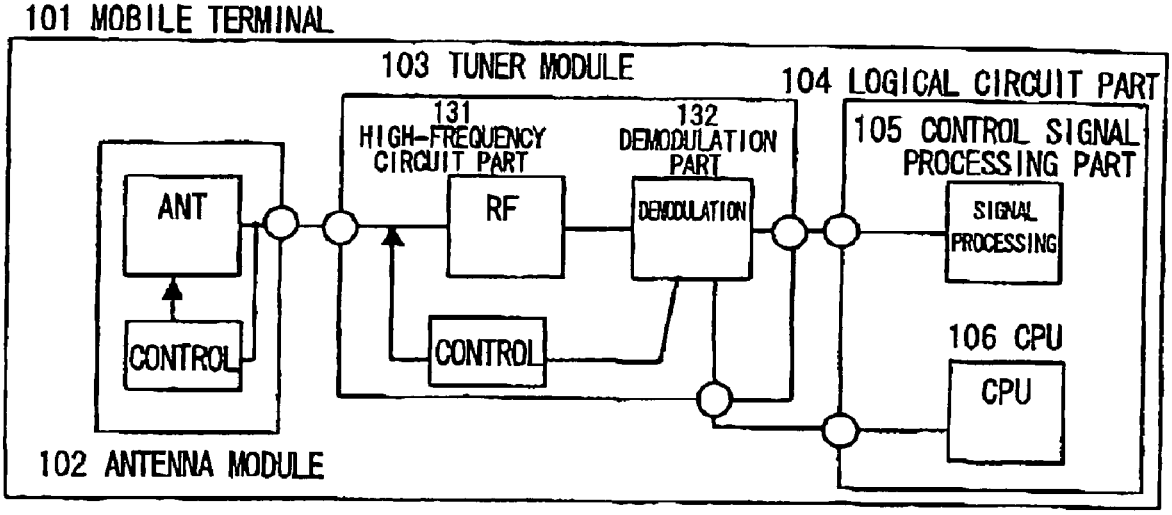
FIG. 9 is a block diagram of a mobile terminal comprising an antenna module according to the invention.

In FIG. 9, as to the same functional blocks used in FIG. 7 the same references are used and detail explanation is omitted.

In the seventh embodiment the antenna module control signal is overlapped with the high-frequency signal line in the tuner module 103. Circuit compositions that in the tuner module 103 the antenna module control signal is overlapped with the high-frequency signal line and in the antenna module the antenna module control signal is extracted from the high-frequency signal line are necessary respectively. In the first embodiment there are two signal lines of the high-frequency signal line and the antenna module control signal line between the tuner module 103 and the antenna module. On the other hand in the seventh embodiment there is only one signal line collectively. Generally a co-axis cable comprising a good noise resistance is used as the high-frequency signal line so that an erroneous operation of the antenna module control can be prevented since a noise is not mixed into the antenna module control signal. Further unnecessary space in the mobile terminal can be reduced. The seventh embodiment is particularly advantageous in a case the tuner module 103 and the antenna module are disposed far from mutually.

Eighth Preferred Embodiment

Figure 10:
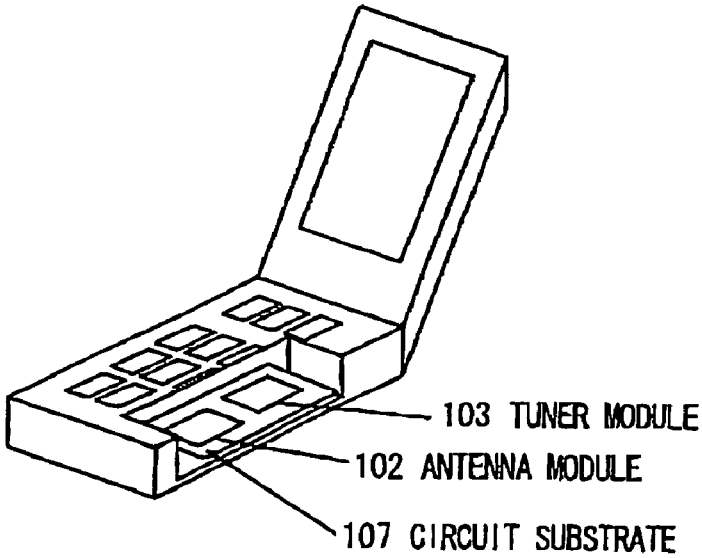
FIG. 10 is a perspective view schematically showing a composition of a mobile terminal comprising an antenna module according to the invention.

FIG. 10 shows an overview of a mobile phone terminal comprising the antenna module shown in the fourth and fifth embodiment. As shown in FIG. 10, in this embodiment it is notable that the antenna module 102 of the invention and the tuner module 103 are directly comprised in a circuit substrate 107 of a mobile phone. The mobile phone of the embodiment comprises a simple composition that only two module components 102, 103 are disposed on the circuit substrate 107 and can realize a good receiving of a digital terrestrial broadcasting, so that new service of a television broadcasting can be provided to users of the mobile phone while maintaining a small size property which is one of the characteristics of the mobile phone.

Ninth Preferred Embodiment

Figure 11:
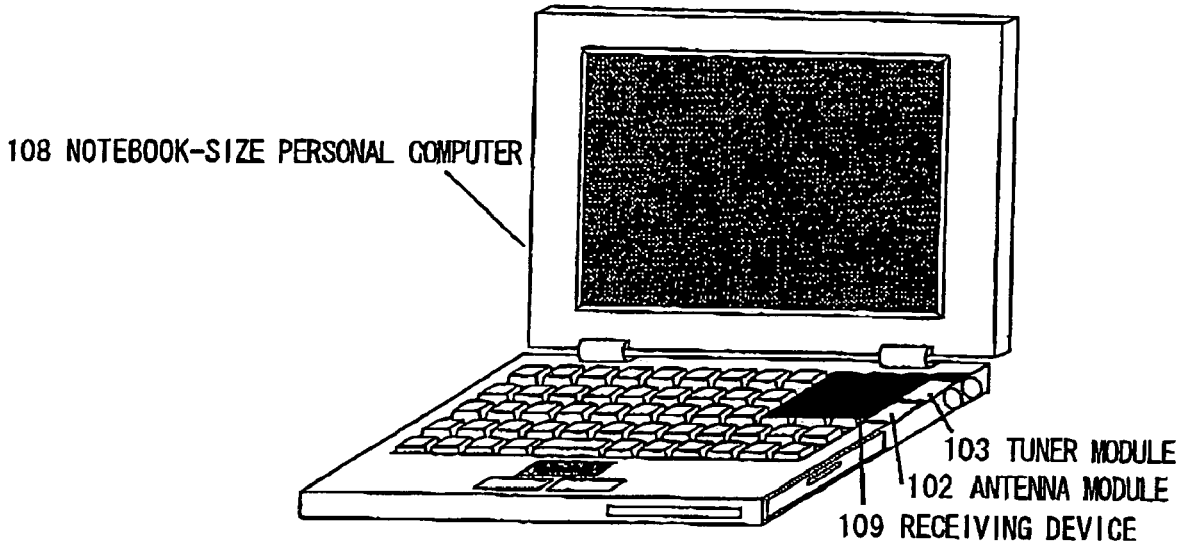
FIG. 11 is a perspective view schematically showing a composition of a notebook-size personal computer comprising an antenna module according to the invention.

FIG. 11 shows an overview of a notebook-size personal computer comprising the antenna module shown in the fourth and fifth embodiment. As shown in FIG. 11, in this embodiment it is notable that the notebook-size personal computer 108 comprises a simple composition that a receiving circuit 109 comprising an intermediate circuit and a base band circuit, the antenna module 102 of the invention, and the tuner module 103 are only comprised in a body of a notebook-size personal computer and can realize a good receiving of a digital terrestrial broadcasting, so that new service of a television broadcasting can be provided to users of the notebook-size personal computer 108 while maintaining a small size property which is one of the characteristics of the notebook-size personal computer. According to the embodiment the antenna module 102 and the tuner module 103 are comprised inside of a covering case of the notebook-size personal computer 108 so that the service of a television broadcasting can be provided without damaging an apparent condition of the notebook-size personal computer.

Further in an article required to be miniaturized such as a mobile phone with a function of receiving a television broadcasting, both a stability and a miniaturization are realized simultaneously. Particularly, in a case of receiving a digital terrestrial broadcasting being suppressed a sending power supply low in comparison with an analogue terrestrial broadcasting, unnecessary waves can be suppressed and a good receiving can be realized.

In a multiple terminal comprising multi-functions, in a case that an antenna is comprised in each different radio terminal respectively, the antenna size depends on a wavelength so that in a case of receiving different wavelengths an individual antenna or an antenna module for each wavelength is needed respectively. Therefore, the downsized antenna module can realize a downsized multiple terminal.

Similarly, the downsized antenna module can realize a downsized radio communication device with a stability of a receiving performance.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna module, comprising:

an integrated multilayer substrate comprising: an antenna comprising a transmission line; a tuned circuit comprising a variable capacitance means; a low noise amplifier; and a wave-shaping circuit, wherein the variable capacitance means in the tuned circuit controls a resonance frequency of the antenna by an external control signal being wave-shaped by the wave-shaping circuit, and the antenna outputs a high-frequency output tuned to the controlled resonance frequency to the low noise amplifier directly and then the low noise amplifier outputs the amplified high-frequency output to outside, wherein a reference table and a comparing circuit are comprised, and the wave-shaping circuit makes an output converge by a feedback mechanism so that a result of comparing an output signal of the wave-shaping circuit and an external control signal becomes equal to a predetermined value given to the reference table.

2. The antenna module according to claim 1, wherein:

the variable capacitance means comprises a switch varying the capacitance of the antenna or a variable capacitance diode varying the capacitance of the antenna.

3. The antenna module according to claim 1, wherein:

the variable capacitance means comprises a capacitance diode varying the capacitance of the antenna, and a capacitance is comprised between the transmission line and the variable capacitance diode so that a resonance frequency is controlled by means of a direct current backward direction voltage being applied at both ends of the variable capacitance diode and a direct-current electricity is prevented from flowing in a transmission line direction.

4. The antenna module according to claim 3, wherein:

a capacitance value of the variable capacitance diode is controlled by an direct-current voltage applied to an electric supply line in overlapped condition through a resistance, and a capacitance is comprised between a ground and the transmission line being electrically earthed to the ground, and also a capacitance is comprised between an electric supply part and connection points of the electric supply part, the resistance and the transmission line.

5. A radio device comprising the antenna module according to claim 1.

6. A radio device according to claim 5, wherein:

the radio device operates by tuning to a resonance frequency of the antenna module.

7. A radio device according to claim 5, wherein:

the radio device operates by synchronizing with the antenna module.

8. A mobile radio terminal comprising the radio device according to claim 5.

9. A mobile radio terminal comprising the antenna module according to claim 1.

10. An antenna module, comprising:

an integrated multilayer substrate comprising: an antenna comprising a transmission line; a tuned circuit comprising a variable capacitance means; a low noise amplifier; and a wave-shaping circuit, wherein the variable capacitance means in the tuned circuit controls a resonance frequency of the antenna by an external control signal being wave-shaped by the wave-shaping circuit, and the antenna outputs a high-frequency output tuned to the controlled resonance frequency to the low noise amplifier directly and then the low noise amplifier outputs the amplified high-frequency output to outside an external control signal terminal, a power supply terminal and a high-frequency signal output terminal are singly comprised as an external terminal, and also a single or a plurality of common ground terminal(s) is (are) comprised.

11. The antenna module according to claim 10, wherein:

the variable capacitance means comprises a switch varying the capacitance of the antenna a variable capacitance diode varying the capacitance of the antenna.

12. The antenna module according to claim 10, wherein:

the variable capacitance means comprises a variable capacitance diode varying the capacitance of the antenna, and a capacitance is comprised between the transmission line and the variable capacitance diode so that a resonance frequency is controlled by means of a direct current backward direction voltage being applied at both ends of the variable capacitance diode and a direct-current electricity is prevented from flowing in a transmission line direction.

13. A radio device comprising the antenna module according to claim 10.

14. A radio device according to claim 13, wherein:

the radio device operates by tuning to a resonance frequency of the antenna module.

15. A radio device according to claim 13, wherein:

the radio device operates by synchronizing with the antenna module.

16. A mobile radio terminal comprising the radio device according to claim 13.

17. A mobile radio terminal comprising the antenna module according to claim 10.

18. An antenna module, comprising:

an integrated multilayer substrate comprising: an antenna; a low noise amplifier; a tuned circuit; and a wave-shaping circuit, wherein the antenna shares the variable capacitance means with the tuned circuit, an input terminal of the low noise amplifier is connected to an output terminal of the antenna in high-frequency, the wave-shaping circuit is inputted an external control signal, and outputs it to the tuned circuit, and a frequency characteristic of a receiving signal, the frequency characteristic which is received by the antenna and amplified by the low noise amplifier, is controlled by the external control signal.

19. An antenna module, comprising:

an integrated multilayer substrate comprising: an antenna; a low noise amplifier; a tuned circuit; and a wave-shaping circuit, and further comprising an external control signal terminal, a power supply terminal and a high-frequency signal output terminal that are singly comprised as an external terminal, as well as a common ground terminal, wherein the antenna shares the variable capacitance means with the tuned circuit, a control signal supplied from the external control signal terminal is wave-shaped to a signal waveform being capable of controlling the variable capacitance means in the tuned circuit by the wave-shaping circuit, the tuned circuit changes a capacitance value of the variable capacitance means shared with the antenna and moves a central frequency of a radio signal received by the antenna, the low noise amplifier amplifies a received signal of the antenna and supplies it to the high-frequency signal output terminal, and a control of the central frequency of a radio signal received by a receiving circuit of a radio device comprising the antenna module is conducted in conjunction with a control of the central frequency of a radio signal received by the antenna module.

20. An antenna module according to claim 19, wherein:

a frequency band of the radio signal received by the antenna module is narrower than a whole frequency band used by a radio system with the antenna module, and the central frequency of the radio signal received by the antenna module is variable so that the antenna module can receive the whole frequency band used by a radio system with the antenna module.

21. An antenna module, comprising:

an integrated multilayer substrate comprising: an antenna; a low noise amplifier; a tuned circuit; and a wave-shaping circuit, wherein the antenna shares the variable capacitance means with the tuned circuit, an input terminal of the low noise amplifier is connected to an output terminal of the antenna in high-frequency, the wave-shaping circuit is inputted an external control signal, and outputs it to the tuned circuit, and a frequency characteristic of a receiving signal, the frequency characteristic which is received by the antenna and amplified by the low noise amplifier, is controlled by the external control signal, wherein a frequency band of the radio signal received by the antenna module is narrower than a whole frequency band used by a radio system with the antenna module, and the central frequency of the radio signal received by the antenna module is variable so that the antenna module can receive the whole frequency band used by a radio system with the antenna module.

22. An antenna module, comprising:

an integrated multilayer substrate comprising: an antenna comprising a transmission line; a tuned circuit comprising a variable capacitance means; a low noise amplifier; and a wave-shaping circuit, wherein the variable capacitance means in the tuned circuit controls a resonance frequency of the antenna by an external control signal being wave-shaped by the wave-shaping circuit, and the antenna outputs a high-frequency output tuned to have a frequency equal to the controlled resonance frequency to the low noise amplifier directly and then the low noise amplifier outputs the amplified high-frequency output to outside.

23. The antenna module according to claim 22, wherein:

the antenna comprises an antenna impedance of being inductive at an output point of the antenna.

24. A radio device comprising the antenna module according to claim 22.

25. A radio device according to claim 24, wherein:

the radio device operates by synchronizing with the antenna module.

26. A mobile radio terminal comprising the radio device according to claim 24.

* * * * *